US008851702B2

(12) United States Patent
Lau

(10) Patent No.: US 8,851,702 B2
(45) Date of Patent: Oct. 7, 2014

(54) COLLAPSIBLE LANTERN

(76) Inventor: Fermi Chi Hung Lau, Hong Kong (HK)

( * ) Notice: Subject to any disclaimer, the term of this patent is extended or adjusted under 35 U.S.C. 154(b) by 157 days.

(21) Appl. No.: 13/425,419

(22) Filed: Mar. 21, 2012

(65) Prior Publication Data

US 2013/0250564 A1 Sep. 26, 2013

(51) Int. Cl.

| | |
|---|---|
| ***F21L 4/00*** | (2006.01) |
| ***F21L 19/00*** | (2006.01) |
| ***F21S 8/00*** | (2006.01) |
| ***F21V 17/02*** | (2006.01) |

(52) U.S. Cl.
USPC ..... 362/188; 362/162; 362/167; 362/186; 362/208; 362/321

(58) Field of Classification Search
USPC ..... 362/157, 162, 167, 171, 186–190, 202, 362/268, 276, 277, 311.01, 311.02, 311.14
See application file for complete search history.

(56) References Cited

U.S. PATENT DOCUMENTS

| | | | | |
|---|---|---|---|---|
| 2,647,254 | A * | 7/1953 | Brunnhoelzl | 340/321 |
| 4,458,303 | A * | 7/1984 | Berns | 362/321 |
| 5,588,739 | A * | 12/1996 | Nakao | 362/205 |
| 6,598,993 | B1 * | 7/2003 | Dalton et al. | 362/202 |
| 7,473,007 | B1 * | 1/2009 | Wang | 362/187 |
| 7,775,686 | B2 * | 8/2010 | Dalton et al. | 362/321 |
| 2001/0024367 | A1 * | 9/2001 | Shiau | 362/188 |
| 2006/0245184 | A1 * | 11/2006 | Galli | 362/208 |

* cited by examiner

*Primary Examiner* — Hargobind S Sawhney
*Assistant Examiner* — Alexander Garlen
(74) *Attorney, Agent, or Firm* — Raymond Y. Chan; David and Raymond Patent Firm

(57) ABSTRACT

A collapsible lantern includes a lantern housing, an illumination unit and a collapsible arrangement. The latter includes a tubular lens body and a light controlling cap assembly. The tubular lens body is movably extended from the front side of the lantern housing to move between a collapsed position and a lantern position. The light controlling cap assembly has a light window and includes a light shelter, in such a manner that when the tubular lens body is at the collapsed position, the tubular lens body is moved into the lantern housing while the light shelter is driven to open the light window for allowing illumination to reach an exterior of the lantern housing. When the tubular lens body is at the lantern position, the tubular lens body is moved out of the lantern housing while the light shelter is driven to close the light window.

8 Claims, 4 Drawing Sheets

COLLAPSIBLE LANTERN

BACKGROUND OF THE PRESENT INVENTION

1. Field of Invention

The present invention relates to a lantern, and more particularly to a collapsible lantern comprising a collapsible arrangement which is capable of allowing the lantern to conveniently work between two different modes of operation.

2. Description of Related Arts

A conventional illumination device, such as a spot light, usually comprises a housing and an illumination device provided in the housing for selectively generating illumination toward a particular spot. The user may manual hold the spot light and point it towards a desirable position. Conventionally, spot lights such as those described above usually generate illumination from a single point source of light. This kind of illumination pattern is highly beneficial when the user needs to illuminate a particular spot in larger space.

On the other hand, a conventional lantern usually comprises a housing and an illumination device mounted in the housing for providing illumination in a predetermined area. Very often, such conventional lantern utilizes fluorescent light as a light source for providing a line source of light. Such light source sacrifices light intensity for spatial reaching of the illumination. In other words, conventional lantern usually produces illumination that can have a wider area of illumination than that of spot light. However, the intensity of the illumination of lanterns is usually substantially smaller than traditional spot lights. Thus, it is not suitable for a person to use a lantern to illuminate a particular spot. Rather, the person has to use a spot light for such purpose. On the other hand, it is also not suitable for a person to use a spot light to provide illumination for a relatively larger area of space, because conventional spot lights are designed to provide illumination of high intensity at a desirable spot.

Because of these limitations, people have to purchase one lantern and one spot light for different purposes. Moreover, there exist a hybrid type of lamp in which it comprises both a point source of light and a fluorescent lamp. As such, this type of lamp may provide both types of illuminations. However, one major disadvantage of this type of lamp is that it is very bulky in size, because it typically comprises a fluorescent lamp and a high-intensity LED or light bulk mounted at different positions of a housing. Since the housing must accommodate two different kinds of light source, the size of the housing is very bulky. This disadvantage substantially impairs widespread application of this type of lamp.

SUMMARY OF THE PRESENT INVENTION

The invention is advantageous in that it provides a collapsible lantern comprising a collapsible arrangement which is capable of allowing the lantern to conveniently work between two different modes of operation.

Another advantage of the invention is to provide a collapsible lantern which is capable of working in two different modes, wherein each of these modes provides different kinds of illumination for a desirable purpose. For example, the collapsible lantern of the present invention is capable of providing a point source of light for allowing it to work as a spot light.

Another advantage of the invention is to provide a collapsible lantern comprising a collapsible arrangement, which is capable of altering an overall size of the collapsible lantern when it is working in two different modes. In other words, the present invention resolves the difficulties for conventional spot lights and lanterns as mentioned above.

Another advantage of the invention is to provide a collapsible lantern comprising a collapsible arrangement which comprises a tubular lens body capable of selectively moving between a collapsed position and a lantern position for facilitating the collapsible lantern to work as a lantern and a spot light respectively.

Another advantage of the invention is to provide a collapsible lantern which does not involve complicated mechanical and electrical structures so that the manufacturing cost and the ultimate selling price of the present invention can be optimally minimized.

Additional advantages and features of the invention will become apparent from the description which follows, and may be realized by means of the instrumentalities and combinations particular point out in the appended claims.

According to the present invention, the foregoing and other objects and advantages are attained by providing a collapsible lantern, comprising:

a lantern housing having a front side and a rear side and a receiving cavity defined between the front side and the rear side;

an illumination unit provided in the receiving cavity of the lantern for generating illumination; and a collapsible arrangement, which comprises:

a tubular lens body which has a light cavity and a light admissible sidewall, and is movably extended from the front side of the lantern housing to move between a collapsed position and a lantern position; and a light controlling cap assembly having a light window provided at a front end portion of the tubular lens body and aligned with the illumination unit, wherein the light controlling cap assembly comprises a light shelter operatively mounted thereon to selectively cover the light window, in such a manner that when the tubular lens body is at the collapsed position, the tubular lens body is moved into the lantern housing so as to allow the light controlling cap assembly to overlappedly rest on the front side of the lantern housing, while the light shelter is driven to open the light window for allowing the illumination generated by the illumination unit to reach an exterior of the lantern housing through the light window, wherein when the tubular lens body is at the lantern position, the tubular lens body is moved frontwardly out of the lantern housing while the light shelter is driven to close the light window so that the illumination generated by the illumination unit is able to reach an exterior of the lantern housing through the light admissible sidewall of the tubular lens body.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
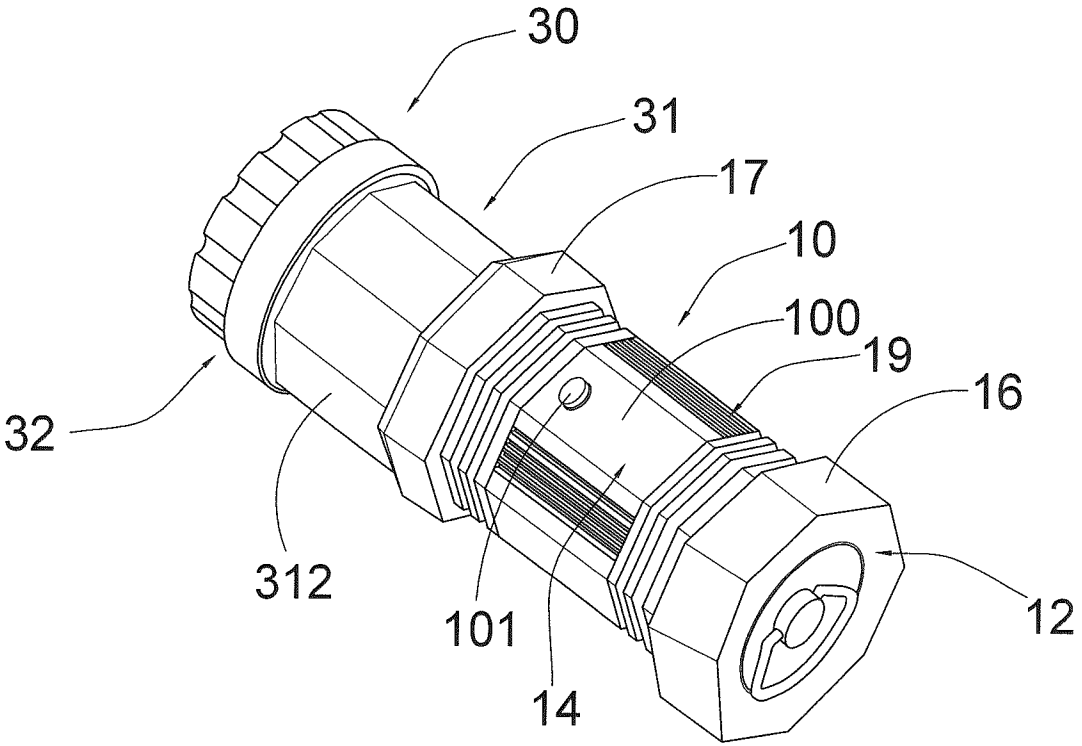
FIG. 1 is a perspective view of a collapsible lantern according to a preferred embodiment of the present invention.
Figure 2:
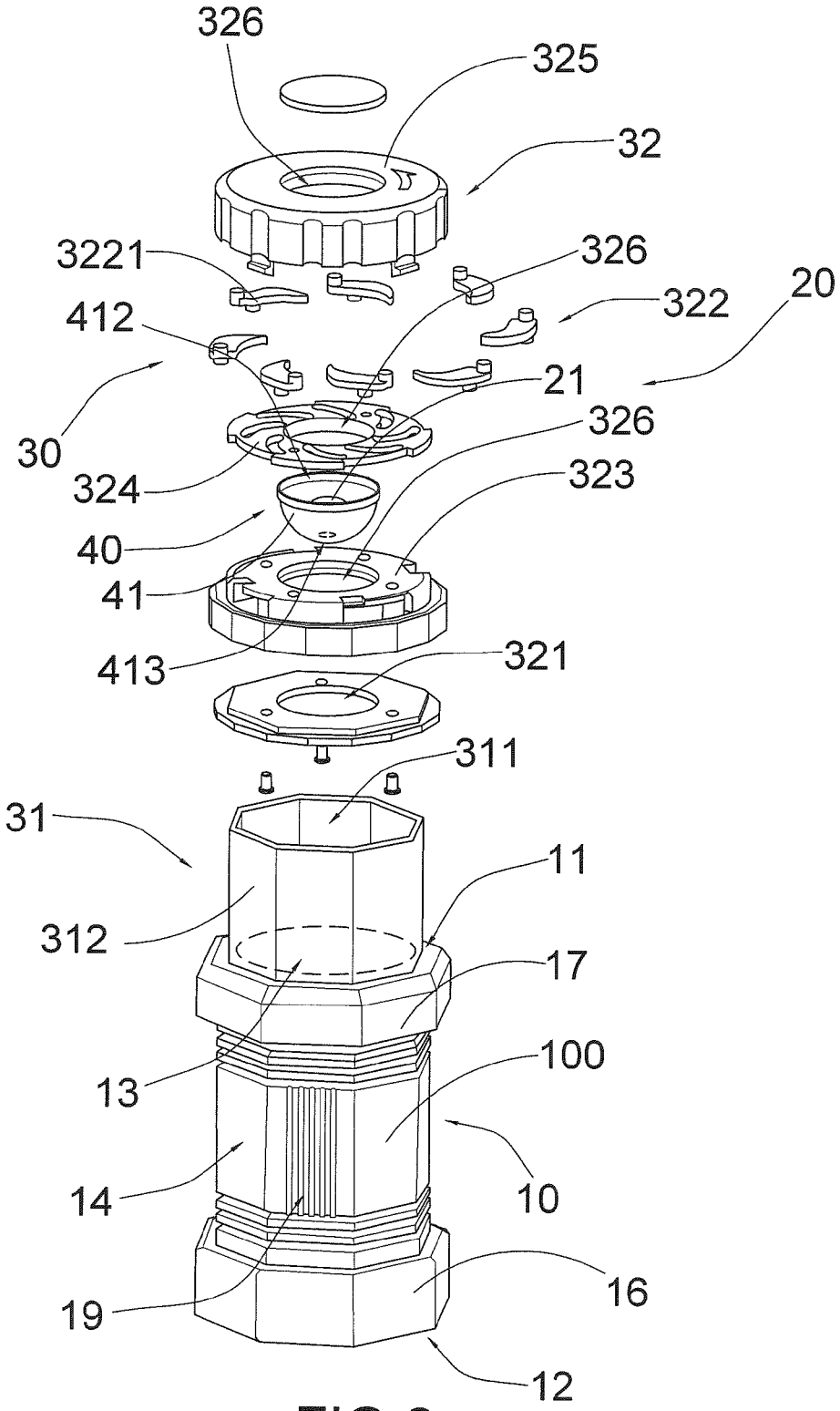
FIG. 2 is an exploded perspective view of a collapsible lantern according to the above preferred embodiment of the present invention.

Referring 1 to FIG. 3, and FIG. 4A to FIG. 4C of the drawings, a collapsible lantern according to a preferred embodiment of the present invention is illustrated, in which the collapsible lantern comprises a lantern housing 10, an illumination unit 20, and a collapsible arrangement 30.

The lantern housing 10 has a front side 11 and a rear side 12 and a receiving cavity 13 defined between the front side 11 and the rear side 12, wherein the illumination unit 20 provided in the receiving cavity 13 of the lantern housing 10 for generating illumination.

The collapsible arrangement 30 comprises a tubular lens body 31 and a light controlling cap assembly 32. The tubular lens body has a light cavity 311 and a light admissible sidewall 312, and is movably extended from the front side 11 of the lantern housing 10 to move between a collapsed position and a lantern position.

On the other hand, the light controlling cap assembly 32 has a light window 321 provided at a front end portion of the tubular lens body 31 and aligned with the illumination unit 20, wherein the light controlling cap assembly 32 comprises a light shelter 322 operatively mounted thereon to selectively cover the light window 321, in such a manner that when the tubular lens body 31 is at the collapsed position, the tubular lens body 31 is moved into the lantern housing 10 so as to allow the light controlling cap assembly 31 to overlappedly rest on the front side 11 of the lantern housing 10, while the light shelter 322 is driven to open the light window 321 for allowing the illumination generated by the illumination unit 20 to reach an exterior of the lantern housing 10 through the light window 321, wherein when the tubular lens body 31 is at the lantern position, the tubular lens body 31 is moved frontwardly out of the lantern housing 10 while the light shelter 322 is driven to close the light window 321 so that the illumination generated by the illumination unit 20 is able to reach an exterior of the lantern housing 10 through the light admissible sidewall 312 of the tubular lens body 31.

According to the preferred embodiment of the present invention, the lantern housing 10 comprises a housing body 100 which is tubular in structure and has an octagonal cross section for providing a plurality of side surfaces 14, wherein a user is able to grip on some of these side surfaces 14 for manually holding the lantern housing 10. The lantern housing 10 is preferably made of light but durable material so as to maximize the portability of the present invention.

The illumination unit 20 comprises a LED illuminator 21 mounted in the receiving cavity 13 and at a front portion of the lantern housing 10 for generating illumination. Furthermore, the lantern housing 10 has a battery compartment 15 defined in the receiving cavity 13 but at a rear potion of the lantern housing 10 for receiving at least one battery, which is electrically connected to the LED illuminator 21 for providing electrical energy thereto.

The tubular lens body 31 of the collapsible arrangement 30 is made of light admissible material, such as transparent glass or plastic material, for defining light cavity 311 and the light admissible sidewall 312. In this preferred embodiment, the tubular lens body 31 also has an octagonal cross section so that there are altogether eight light admissible sidewalls 312 forming the tubular lens body 31. Each of the light admissible sidewalls 312 allows light to pass through so that when it is in the lantern position, the light in the light cavity 311 can uniformly reach an exterior of the lantern housing 10 and the collapsible lantern of the present invention can act as a lantern for delivering a line source of light from a single point source of light.

The tubular lens body 311 is slidably mounted on the lantern housing 10 for moving between the collapsed position and the lantern position. More specifically, the tubular lens body 311 is mounted in the receiving cavity 13 of the lantern housing 10 in a slidably movable manner, wherein a user is able to slidably move the tubular lens body 311 from the collapsed position to the lantern position or vice versa by moving the light controlling cap assembly 312 attached on a front edge portion of the tubular lens body 311. In other words a longitudinal length of the tubular lens body 311 is slightly longer than that of the lantern housing 10 so that when the tubular lens body 311 is at the collapsed position, the tubular lens body 311 is capable of receiving in the lantern housing 10 for reducing an overall size of the lantern of the present invention. When the tubular lens body 311 is at the lantern position, it is slid out of the lantern housing 10 and an overall size (especially the length) of the lantern is substantially increased for providing uniform illumination to an exterior of the lantern.

As shown in FIG. 1 of the drawings, the lantern housing 10 further comprises a base member 16 provided at a rear portion of the housing body 100 for providing an extended surface area to allow the lantern housing 10 to stand on a ground surface. Thus, the base member 16 has the same cross sectional shape as that of the housing body 100.

Furthermore, the lantern housing 100 further comprises a front supporting member 17 provided at a front end portion of the housing body 100, wherein the light controlling cap assembly 32 is arranged to rest on the front supporting member 17 when the tubular lens body 311 is at the collapsed position. It is worth mentioning that the front supporting member 17 has a cross sectional shape which is substantially the same as that of the housing body 100.

However, as shown in FIG. 1 of the drawings, the sizes of the base member 16 and the front supporting member 17 is slightly larger than the housing body 100. Furthermore, each of the base member 16 and the front supporting member 17 has a through hole formed thereon, wherein the housing body 100 is arranged to insert into the through holes.

The lantern housing 10 further has a plurality of elongated grooves 19 spacedly formed on the housing body 100 for enhancing a frictional property thereof, so that a user is able to comfortably and securely grip on the housing body 100. Furthermore, the lantern housing 10 further comprises a control switch 101 operatively provided on the housing body 100, wherein the control switch 101 is electrically connected to the illumination unit 20 for selectively controlling an operation thereof.

The light controlling cap assembly 32 is preferably circular in cross section and the through light window 321 is formed thereon. The light shelter 322 comprises a plurality of shelter members 3221 spacedly and movably extended from a sidewall of the light window 321 for selectively closing and opening the light window 321. More specifically, the light controlling cap assembly 32 comprises a supporting unit 323 mounted at the top edge portion of the tubular lens body 31, a shelter actuation member 324 rotatably mounted on the supporting unit 323 with respect to the supporting unit 323, and a cap member 325 mounted above the supporting unit 323 and the shelter actuation member 324. Each of the supporting unit 323, the shelter actuation member 324 and the cap member 325 has a central through slot 326 formed thereon to constitute the light window 321 of the light controlling cap assembly 32. The cap member 325 is also rotatably mounted to the supporting unit 323 while the shelter actuation member 324 and the light shelter 322 are sandwiched between the cap member 325 and the supporting unit 323.

The shelter members 3221 of the light shelter 322 are pivotally mounted on the shelter actuation member 324 in such a manner that the shelter members 3221 are selectively driven to close and open the light window 321 by rotation of the shelter actuation member 324. Thus, a user is able to conveniently rotate the cap member 325 in a predetermined direction so as to rotate the shelter actuation member 324 for pivotally driving the shelter members 3221 to close or open the light window 321.

Figure 3:
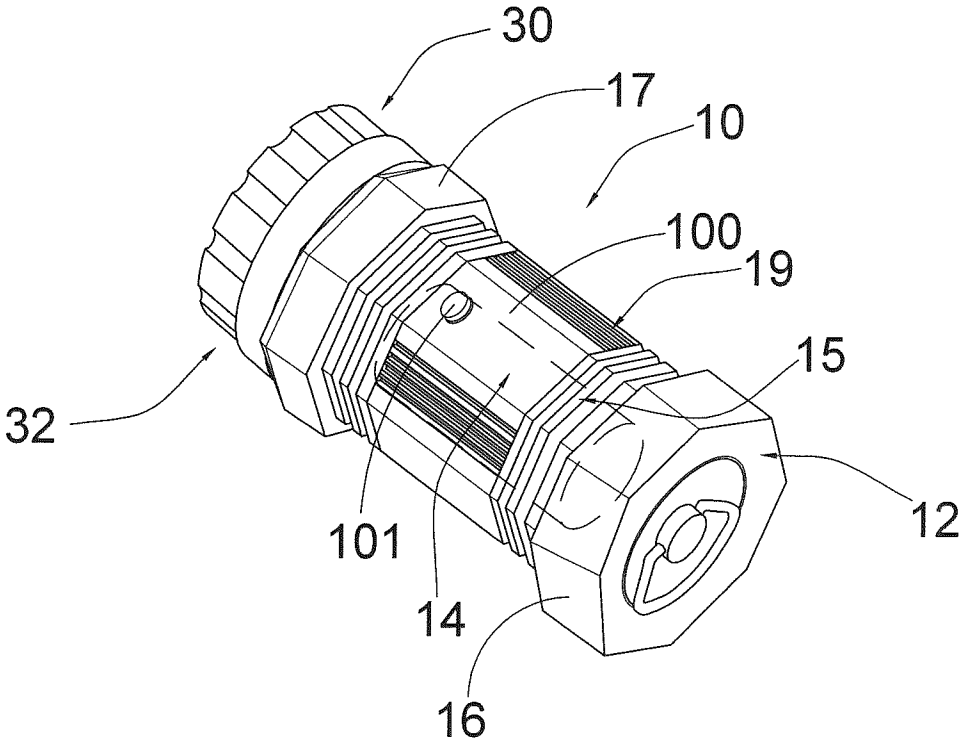
FIG. 3 is a schematic diagram of a collapsible lantern according to the above preferred embodiment of the present invention, illustrating that the tubular lens body is in the collapsed position.
Figure 4C:
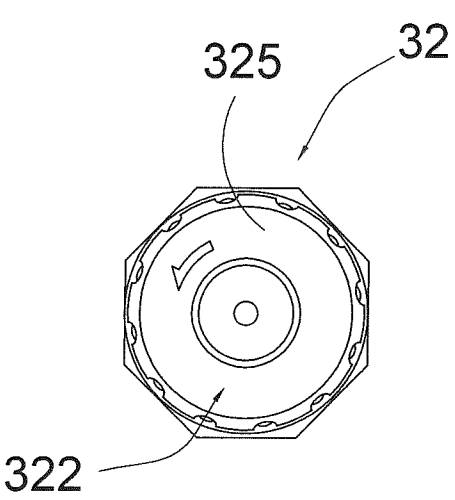
FIG. 4A to FIG. 4C are schematic diagram of a collapsible lantern according to the above preferred embodiment of the present invention, illustrating the different positions of the light controlling cap assembly.
Figure 4B:
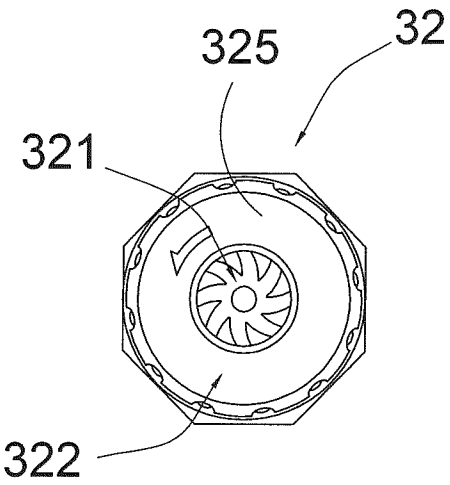

The lantern of the present invention further comprises a light reflector 40 mounted underneath the supporting unit 323 at the light window 321 for reflecting light coming from the illumination unit 20. The light reflector 40 has a conical reflector body 41 to define a reflection cavity 411 within the conical reflector body 41. The conical reflector body 41 further has an inner light reflective surface 412 and a through hole 413 formed at a bottom surface of the light reflector 40 and aligned with the illumination unit 20 such that when the tubular lens body 31 is at the collapsed position, the illumination unit 20 is arranged to receive in the reflection cavity 411. Thus, the light generated from the illumination unit 20 is reflected and converged in the reflection cavity 411 and reaches the exterior of the lantern housing 100 through the light window 321 (FIG. 3 and FIG. 4C). As such, the collapsible lantern may be used as a spot light which provides a point source of light for the user.

Figure 4A:
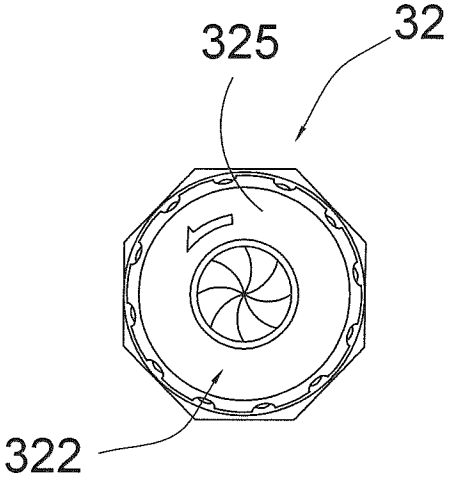

As shown in FIG. 1 and FIG. 3 of the drawings, when the tubular lens body 31 is at the lantern position, the light reflector 40, being attached to the supporting unit 323, is moved upwardly so as to allow the illumination unit 20 to leave the reflection cavity 411 and is received in the light cavity 311 for providing uniformly propagating light through the light admissible sidewalls 312 (FIG. 1 and FIG. 4A). As such, the collapsible lantern of the present invention can be used as a lantern for providing a line source of light for the user.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A collapsible lantern, comprising:

a lantern housing having a front side and a rear side and a receiving cavity defined between said front side and said rear side;

an illumination unit provided in said receiving cavity of said lantern housing for generating illumination; and a collapsible arrangement, which comprises:

a tubular lens body which has a light cavity and a light admissible sidewall, and is movably extended from said front side of said lantern housing to move between a collapsed position and a lantern position; and a light controlling cap assembly having a light window provided at a front end portion of said tubular lens body and aligned with said illumination unit, wherein said light controlling cap assembly comprises a light shelter operatively mounted in front of said light window to selectively cover said light window, wherein said light shelter is selectively moved to close said light window at one of said collapsed position and said lantern position, wherein when said tubular lens body is at said collapsed position, said tubular lens body is moved into said lantern housing so as to allow said light controlling cap assembly to overlappedly rest on said front side of said lantern housing, while said light shelter is moved to open said light window for allowing said illumination generated by said illumination unit to reach an exterior of said lantern housing through said light window, wherein when said tubular lens body is at said lantern position, said tubular lens body is moved frontwardly out of said lantern housing while said light shelter is moved to close said light window so that said illumination generated by said illumination unit is able to reach an exterior of said lantern housing through said light admissible sidewall of said tubular lens body, wherein said illumination unit comprises a LED illuminator mounted in said receiving cavity and at a front portion of said lantern housing for generating illumination, wherein said tubular lens body is moved to align with said LED illuminator, wherein said lantern housing has a battery compartment defined in said receiving cavity at a rear portion of said lantern housing for receiving at least one battery, wherein said tubular lens body of said collapsible arrangement is made of light admissible material for defining said light cavity and said light admissible sidewall, wherein said tubular lens body has an octagonal cross section so that there are eight light admissible sidewalls forming said tubular lens body, wherein said tubular lens body is slidably mounted on said lantern housing for moving between said collapsed position and said lantern position, wherein said tubular lens body is mounted in said receiving cavity of said lantern housing in a slidably movable manner, wherein said tubular lens body is slidably moved from said collapsed position to said lantern position and vice versa by moving said light controlling cap assembly attached on a front edge portion of said tubular lens body, wherein a longitudinal length of said tubular lens body is slightly longer than that of said lantern housing so that when said tubular lens body is at said collapsed position, said tubular lens body is capable of receiving in said lantern housing for reducing an overall size of said lantern, wherein when said tubular lens body is at said lantern position, said tubular lens body is slid out of said lantern housing and an overall size of said lantern is substantially increased for providing uniform illumination to an exterior of said lantern, wherein said lantern housing further comprises a base member provided at a rear portion of said lantern housing for providing an extended surface area to allow said lantern housing to stand on a ground surface, wherein said lantern housing further comprises a front supporting member provided at a front end portion of said lantern housing, wherein said light controlling cap assembly is moved to rest on said front supporting member when said tubular lens body is at said collapsed position, wherein said light controlling cap assembly is circular in cross section, wherein said light shelter comprises a plurality of shelter members spacedly and movably extended from a sidewall of said light window for selectively closing and opening said light window, wherein said light controlling cap assembly comprises a supporting unit mounted at said top edge portion of said tubular lens body, a shelter actuation member rotatably mounted on said supporting unit with respect to said supporting unit, and a cap member mounted above said supporting unit and said shelter actuation member, wherein each of said supporting unit, said shelter actuation member and said cap member has a central through slot formed thereon to constitute said light window of said light controlling cap assembly, wherein said cap member is also rotatably mounted to said supporting unit while said shelter actuation member and said light shelter are sandwiched between said cap member and said supporting unit.

2. The collapsible lantern, as recited in claim 1, wherein said shelter members of said light shelter are pivotally mounted on said shelter actuation member in such a manner that said shelter members are selectively driven to close and open said light window by rotation of said shelter actuation member, such that a user is able to conveniently rotate said cap member in a predetermined direction so as to rotate said shelter actuation member for pivotally driving said shelter members to selectively close and open said light window.

3. The collapsible lantern, as recited in claim 2, wherein said lantern housing comprises a housing body, and has a plurality of elongated grooves spacedly formed on said housing body for enhancing a frictional property thereof, so that a user is able to comfortably and securely grip on said housing body.

4. The collapsible lantern, as recited in claim 3, wherein said lantern housing further comprises a control switch operatively provided on said housing body, wherein said control switch is electrically connected to said illumination unit for selectively controlling an operation thereof.

5. A collapsible lantern, comprising:

a lantern housing having a front side and a rear side and a receiving cavity defined between said front side and said rear side;

an illumination unit provided in said receiving cavity of said lantern housing for generating illumination;

a light reflector; and a collapsible arrangement, which comprises:

a tubular lens body which has a light cavity and a light admissible sidewall, and is movably extended from said front side of said lantern housing to move between a collapsed position and a lantern position; and a light controlling cap assembly having a light window provided at a front end portion of said tubular lens body and aligned with said illumination unit, wherein said light controlling cap assembly comprises a light shelter operatively mounted in front of said light window to selectively cover said light window, wherein said light shelter is selectively moved to close said light window at one of said collapsed position and said lantern position, wherein when said tubular lens body is at said collapsed position, said tubular lens body is moved into said lantern housing so as to allow said light controlling cap assembly to overlappedly rest on said front side of said lantern housing, while said light shelter is moved to open said light window for allowing said illumination generated by said illumination unit to reach an exterior of said lantern housing through said light window, wherein when said tubular lens body is at said lantern position, said tubular lens body is moved frontwardly out of said lantern housing while said light shelter is moved to close said light window so that said illumination generated by said illumination unit is able to reach an exterior of said lantern housing through said light admissible sidewall of said tubular lens body, wherein said illumination unit comprises a LED illuminator mounted in said receiving cavity and at a front portion of said lantern housing for generating illumination, wherein said tubular lens body is moved to align with said LED illuminator wherein said lantern housing has a battery compartment defined in said receiving cavity at a rear portion of said lantern housing for receiving at least one battery, wherein said tubular lens body of said collapsible arrangement is made of light admissible material for defining said light cavity and said light admissible sidewall, wherein said tubular lens body has an octagonal cross section so that there are eight light admissible sidewalls forming said tubular lens body, wherein said tubular lens body is slidably mounted on said lantern housing for moving between said collapsed position and said lantern position, wherein said tubular lens body is mounted in said receiving cavity of said lantern housing in a slidably movable manner, wherein said tubular lens body is slidably moved from said collapsed position to said lantern position and vice versa by moving said light controlling cap assembly attached on a front edge portion of said tubular lens body, wherein a longitudinal length of said tubular lens body is slightly longer than that of said lantern housing so that when said tubular lens body is at said collapsed position, said tubular lens body is capable of receiving in said lantern housing for reducing an overall size of said lantern, wherein when said tubular lens body is at said lantern position, said tubular lens body is slid out of said lantern housing and an overall size of said lantern is substantially increased for providing uniform illumination to an exterior of said lantern, wherein said light reflector is mounted underneath said supporting unit at said light window for reflecting light coming from said illumination unit, wherein said light reflector has a conical reflector body to define a reflection cavity within said conical reflector body, wherein said conical reflector body further has an inner light reflective surface and a through hole formed at a bottom surface of said light reflector and aligned with said illumination unit such that when said tubular lens body is at said collapsed position, said illumination unit is arranged to receive in said reflection cavity, wherein when said tubular lens body is at said lantern position, said light reflector, being attached to said supporting unit, is moved upwardly so as to allow said illumination unit to leave said reflection cavity and is received in said light cavity for providing uniformly propagating light through said light admissible sidewalls, wherein said lantern housing further comprises a base member provided at a rear portion of said lantern housing for providing an extended surface area to allow said lantern housing to stand on a ground surface, wherein said lantern housing further comprises a front supporting member provided at a front end portion of said lantern housing, wherein said light controlling cap assembly is moved to rest on said front supporting member when said tubular lens body is at said collapsed position, wherein said light controlling cap assembly is circular in cross section, wherein said light shelter comprises a plurality of shelter members spacedly and movably extended from a sidewall of said light window for selectively closing and opening said light window, wherein said light controlling cap assembly comprises a supporting unit mounted at said top edge portion of said tubular lens body, a shelter actuation member rotatably mounted on said supporting unit with respect to said supporting unit, and a cap member mounted above said supporting unit and said shelter actuation member, wherein each of said supporting unit, said shelter actuation member and said cap member has a central through slot formed thereon to constitute said light window of said light controlling cap assembly, wherein said cap member is also rotatably mounted to said supporting unit while said shelter actuation member and said light shelter are sandwiched between said cap member and said supporting unit.

6. The collapsible lantern, as recited in claim 5, wherein said shelter members of said light shelter are pivotally mounted on said shelter actuation member in such a manner that said shelter members are selectively driven to close and open said light window by rotation of said shelter actuation member, such that a user is able to conveniently rotate said cap member in a predetermined direction so as to rotate said shelter actuation member for pivotally driving said shelter members to selectively close and open said light window.

7. The collapsible lantern, as recited in claim 6, wherein said lantern housing comprises a housing body, and has a plurality of elongated grooves spacedly formed on said housing body for enhancing a frictional property thereof, so that a user is able to comfortably and securely grip on said housing body.

8. The collapsible lantern, as recited in claim 7, wherein said lantern housing further comprises a control switch operatively provided on said housing body, wherein said control switch is electrically connected to said illumination unit for selectively controlling an operation thereof.

* * * * *